US006726116B2

(12) United States Patent
Hofstetter, Sr.

(10) Patent No.: US 6,726,116 B2
(45) Date of Patent: Apr. 27, 2004

(54) RAILWAY CROSSING STRUCTURE

(75) Inventor: Don R. Hofstetter, Sr., Montville, OH (US)

(73) Assignee: Iron Horse Engineering Co., Parkman, OH (US)

( * ) Notice: Subject to any disclaimer, the term of this patent is extended or adjusted under 35 U.S.C. 154(b) by 0 days.

(21) Appl. No.: 10/383,282

(22) Filed: Mar. 7, 2003

(65) Prior Publication Data

US 2003/0168519 A1 Sep. 11, 2003

Related U.S. Application Data

(60) Provisional application No. 60/362,636, filed on Mar. 8, 2002.

(51) Int. Cl.[7] ..... E01B 1/00
(52) U.S. Cl. ..... 238/8
(58) Field of Search ..... 238/8, 2, 3, 9

(56) References Cited

U.S. PATENT DOCUMENTS

| | | | | |
|---|---|---|---|---|
| 4,606,498 A | | 8/1986 | Grant et al. | 238/8 |
| 4,793,545 A | | 12/1988 | Raymond | 238/8 |
| 4,899,933 A | | 2/1990 | Martin | 238/8 |
| 4,919,330 A | | 4/1990 | Winger | 238/8 |
| 5,165,598 A | | 11/1992 | Ortwein | 238/283 |
| 5,181,657 A | | 1/1993 | Davis | 238/8 |
| 5,298,214 A | | 3/1994 | Morrow et al. | 264/211.12 |
| 5,464,152 A | | 11/1995 | Wabnitz | 238/8 |
| 5,538,182 A | * | 7/1996 | Davis et al. | 238/8 |
| 5,577,662 A | | 11/1996 | Hogue et al. | 238/8 |
| 5,609,294 A | | 3/1997 | Lucas, Jr. | 238/9 |
| 5,622,312 A | | 4/1997 | Martin | 238/2 |
| 5,626,289 A | | 5/1997 | Demers, Jr. et al. | 238/8 |
| 5,988,519 A | | 11/1999 | Jordie | 238/15 |
| 6,068,195 A | | 5/2000 | Gaudet | 238/8 |
| 6,293,473 B1 | | 9/2001 | Ortwein et al. | 238/2 |
| 6,296,195 B1 | | 10/2001 | Blank et al. | 238/2 |
| 6,588,677 B2 | * | 7/2003 | Hofstetter et al. | 238/283 |

* cited by examiner

*Primary Examiner*—S. Joseph Morano
*Assistant Examiner*—Robert J. McCarry, Jr.
(74) *Attorney, Agent, or Firm*—Pearne & Gordon LLP

(57) ABSTRACT

An insulation system for an embedded track construction for a transit railway having spaced parallel railway rails includes a rail boot for substantially enclosing each of the rails along its length, rail clips extending on each side of each of the rails for securing the rails to supporting ties, and fillers extending on each side of each of the rails, frictionally engaging and removably mounting the rails to an associated one of said rail clips. The fillers cooperate to provide a coplanar roadway with said rails.

22 Claims, 4 Drawing Sheets

RAILWAY CROSSING STRUCTURE

This application claims the priority of U.S. Provisional Application No. 60/362,636, filed Mar. 8, 2002.

BACKGROUND OF THE INVENTION

1. Field of the Invention

The present invention relates to the art of railway track assemblies and more particularly, to an embedded railway track structure using elastomeric elements.

2. Description of the Related Art

Construction of railroad tracks along streets has long presented the problem of how to provide long-lasting serviceability and track evenness with the road surface, while still giving needed access to the rails and supporting structures at lesser expense than has previously been possible.

Where tracks are embedded in pavement it is necessary to have a gutter to contain each rail, yet is must also be possible to gain access to the rail, its supporting structures, and fasteners attaching the rail to the supporting structures, once the gutter has been sealed.

Many highways and arterials which cross railroad tracks utilize elastomeric crossing elements. Crossings, using elastomeric elements not only are inherently smoother than crossings made from non-elastomeric materials, but maintain their smoothness much longer.

Timber crossings, for example, wear quite quickly and soon present a rough crossing surface. While asphalt wears better than timber, it is difficult to compact asphalt immediately adjacent to the rails. Thus, an asphalt grade crossing soon settles adjacent to the rails which also creates a rough surface. In addition, it is difficult to prevent water from entering between the asphalt and the rails and when freezing occurs the water expands and causes deterioration of the asphalt. Concrete wears better than asphalt and does not require mechanical compaction, however, freezing is a problem with this material also. In addition, concrete grade crossings usually have metal edges which occasionally causes shorting to occur between the rails which can activate the crossing signs.

Not only do elastomeric grade crossing elements provide greater smoothness, they are easier to remove than timber, concrete or asphalt which permits them to be reused when the track is brought up to grade by adding ballast and retamping.

Raymond U.S. Pat. No. 4,793,545 discloses sealing insert assemblies which extend along the length of the rails of an embedded track, but which appear likely to be costly to construct and yet unable to provide access to the rail support structure for repair.

Davis U.S. Pat. No. 5,181,657 discloses a grade crossing system including elastomeric pad units located along each side of the rails for supporting automobile traffic crossing railroad tracks. The disclosed structure, however, requires specially pre-cast panels which rest on the pads, making such structure undesirably expensive for use along a railway track embedded in a paved street.

Lucas U.S. Pat. No. 5,609,294 discloses a railroad track assembly that includes rubber filler bodies held in place along the sides of each rail by retainer strips which lock into place on the filler bodies. A retainer form is placed over the top of the rail and filler bodies, holding the filler bodies in place closely alongside the rail. Paving material is placed alongside the rail structure, including the retainer form, whose depending legs act as a form for the paving material to define a slot alongside the filler bodies. The disclosed structure, however, requires the retainer form to be removed from atop the rail and filler bodies and the retainer strips are forced into the slot making the structure undesirably expensive and its installation time consuming.

Additionally, in order to avoid undesired unevenness of the surface of a street across or along which a railroad track runs, it is desirable that the pavement surface be approximately level with the height of the top of the rails of the track and that appropriate resilient filler structure be provided between the pavement and each rail to support motor vehicle traffic. Such filler structures are an added expense and, moreover, must not interfere with passage of railroad cars along the track.

What is desired, then, is a structure for railroad tracks embedded in a roadway, which is easier and less costly than previously used structures yet can provide long-lasting serviceability and track evenness, while still giving needed access to the rails and supporting structures at lesser expense than has previously been possible.

SUMMARY OF THE INVENTION

The present invention overcomes the aforementioned shortcomings of the prior art and provides a railway track structure that is serviceable and maintains its evenness after extended use. The railway track structure includes a pair of spaced parallel rails, secured by fasteners to transversely extending crossties or support beams. Each rail has a base portion, a head portion and a web portion integrally connecting the head and base portions. A plurality of rail clips, formed from an elastomeric material, include a cavity for receiving the rail fastener and engage the rails at spaced apart positions. An elastomeric boot formed as a continuous piece encases the rail. The boot includes a body having two exposed top surfaces, an inner surface, and an outer surface. The boot extends from the base portion of the rail to cover substantially all of an outer surface of the head portion. The rail clips contact an outer surface of the boot near the base portion of the rail. A pair of preformed filler bodies, formed from an elastomeric material, reside alongside a respective outer surface of the rail boot body and are in sealable contact with the rail boot body. The bottom surface of the filler bodies are engagingly attached to a respective rail clip.

In this manner, the railway track structure of the invention may be assembled to provide a grade crossing or a so-called grass track roadway which both enjoy a substantially coplanar surface with the top surfaces of the rails.

These and other aspects of this invention are illustrated in the accompanying drawings, and are more fully disclosed in the following specification.

DESCRIPTION OF AN EXAMPLE EMBODIMENT

Figure 1:
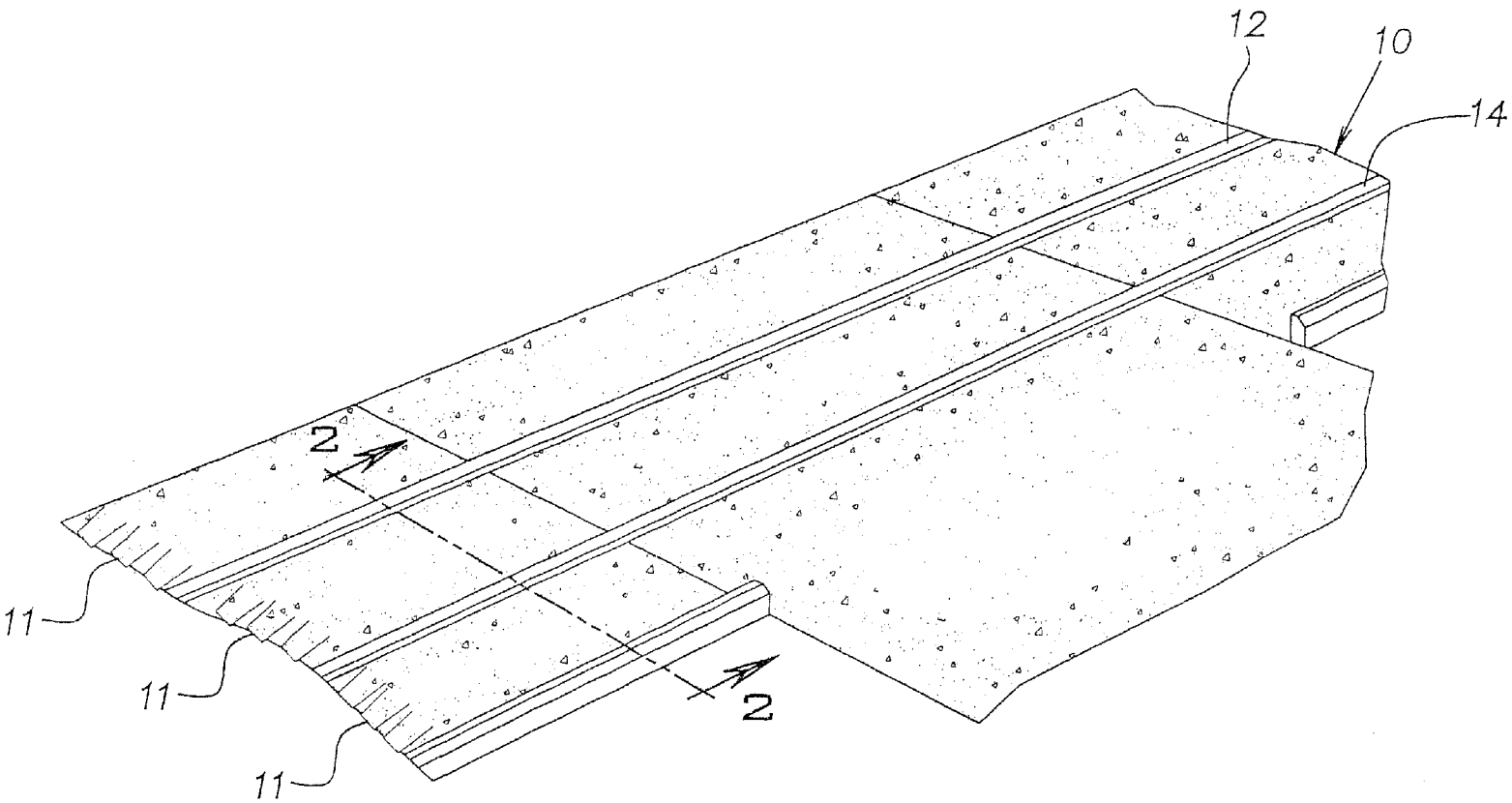
FIG. 1 is a perspective view of an embedded track assembly at a grade crossing according to the invention.
Figure 2:
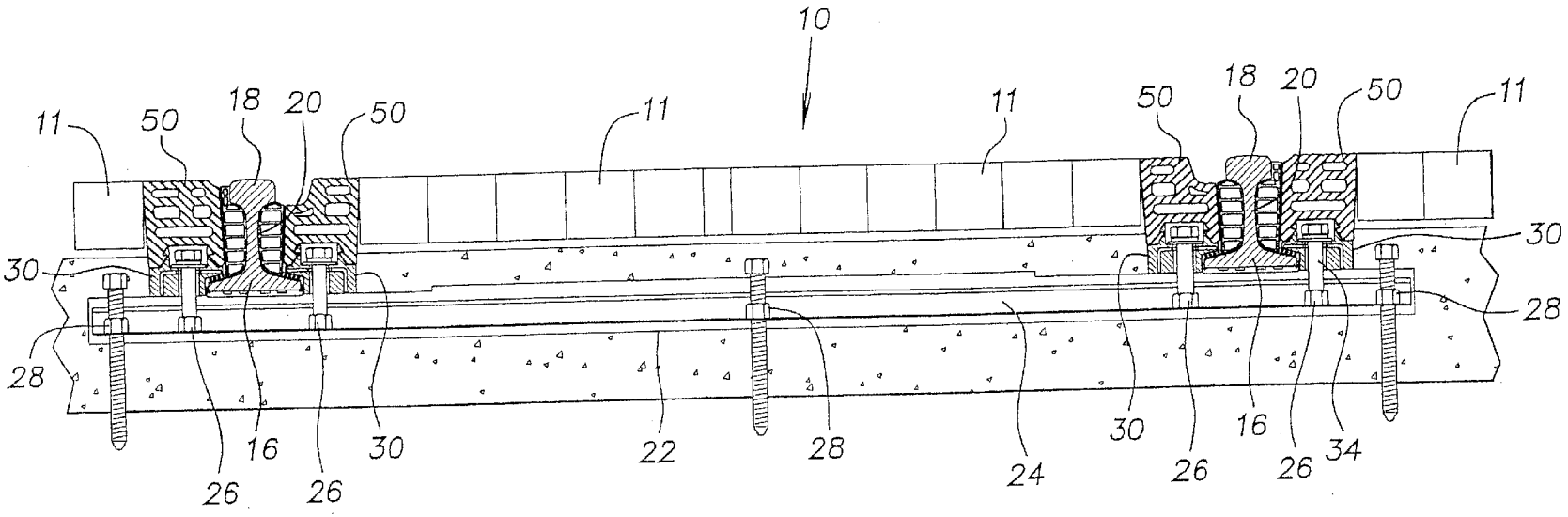
FIG. 2 is a vertical cross-sectional view of the railway track structure generally along the lines 2—2 of FIG. 1.

Referring now to the drawings wherein the showings are for purposes of illustrating an example embodiment of the invention only and not for limiting the same, FIGS. 1 and 2 show a railway track structure 10 that is serviceable and electrically insulates the rails from the surrounding ground surface.

More particularly, the railway structure includes a pair of spaced parallel rails 12, 14 each having a generally I-shaped cross-section, for example, a 115 RE type rail. Each rail includes a base portion 16 or rail flange, a head portion 18 and a web 20 integrally connecting the head and base portions. Paver blocks 11 define a finished grade but are incidental to the design. The finished grade could be any structural material or comprise a grass median strip in a so-called grass track application. The area currently filled in with the paver blocks 11 could be filled in with concrete or asphalt.

Typically, the base portion 16 of rail 12, 14 is operatively supported along a plurality of transversely extending cross-ties or support beams 22. Support beams made from materials such as concrete are normally used, but a support beam 22 made from 100% HDPE extruded material may also be used in the invention. The support beam 22, for example as shown in FIG. 2 made from 100% HDPE extruded material, includes a structurally supplemented steel uni-strut 24 molded into the support beam 22. The structurally supplemented steel uni-strut 24 could also be substituted with a pulltruded, glass or carbon fiber reinforced structure of a similar construction. The uni-strut 24 includes beam anchor nuts 26 and beam leveling/support nuts 28 that are pre-positioned and formed integral with the structurally supplemented steel uni-strut 24.

Figure 3:
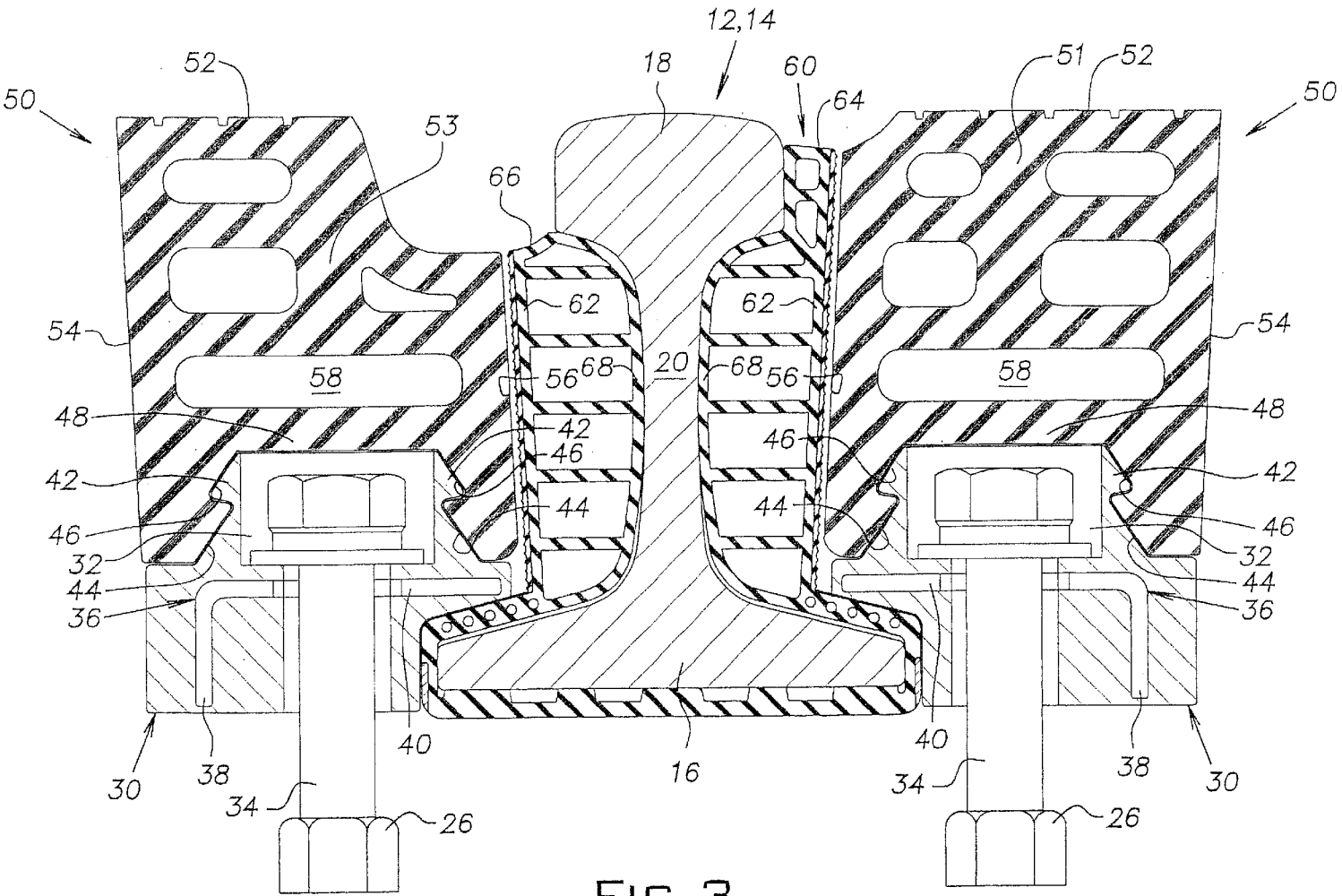
FIG. 3 is an enlarged, cross-sectional view of an embodiment of the invention.

Referring now to FIG. 3, to firmly retain the rails on the support beam 22 a plurality of rail clips 30 are provided. The clips 30 are formed from an elastomeric material and include a cavity 32 for receiving the rail fastener 34. The clip 30 is manufactured as a composite extrusion piece from various elastomers being good electrical insulators. The clips 30 continuously engage the rails 12, 14 and are secured to cross-ties at spaced apart positions. Accordingly, composite clips 30 may be extruded in selected longitudinal lengths, cavities 32 may be provided at selected locations corresponding with cross tie spacing and installed in abutting relationship along each side of the rail 12, 14.

The rail clips 30 further include a steel angle section indicated generally at 36, encapsulated in the elastomeric material having an downwardly directed flange 38 spaced horizontally from the rail base portion 16 and disposed alongside the rail base portion 16 and a horizontally directed flange 40 lying at a right angle to the downwardly directed flange 38 and disposed perpendicular to the rail base portion 16.

Each respective rail clip 30 includes an outwardly projecting top male dovetail portion 42. The top male portion 42 contains a lower surface 44 that projects upwardly at an angle and terminates in an upper surface 46 having a flat bottom surface which projects slightly upwardly, and a convex arcuate surface to facilitate interlocking with a bottom female dovetail portion 48 on a preformed filler body 50.

The preformed filler bodies 50 formed from an elastomeric material are provided in pairs for each rail 12, 14. Each filler body 50 having a top surface 52, a bottom portion 48 and side surfaces 54, 56. The outside of the rail 12, 14 will be referred to as the field side, being the right half of FIG. 3. The inside of the rail 12, 14 will be referred to as the gauge side, being the left half of FIG. 3. Filler body 51 is located on the field side of the rail. Filler body 53 is located on the gauge side of the rail and receives a flange for an associated rail wheel. A gauge and a field side filler body is used in railway track structure 10.

Filler bodies 51, 53 are manufactured from various elastomers being good electrical insulators. The bodies 51, 53 can easily be provided in any lengths required to minimize joints and extend as far as possible within the embedded track structure 10, which varies among crossings. Each filler body 50 is located alongside a respective outer surface or side 62 of a rail boot 60 and is in sealable contact with the outer surface 62. The bottom portion 48 of the filler body 50 engagingly attaches to a projecting top male portion 42 of respective rail clip 30.

Figure 4:
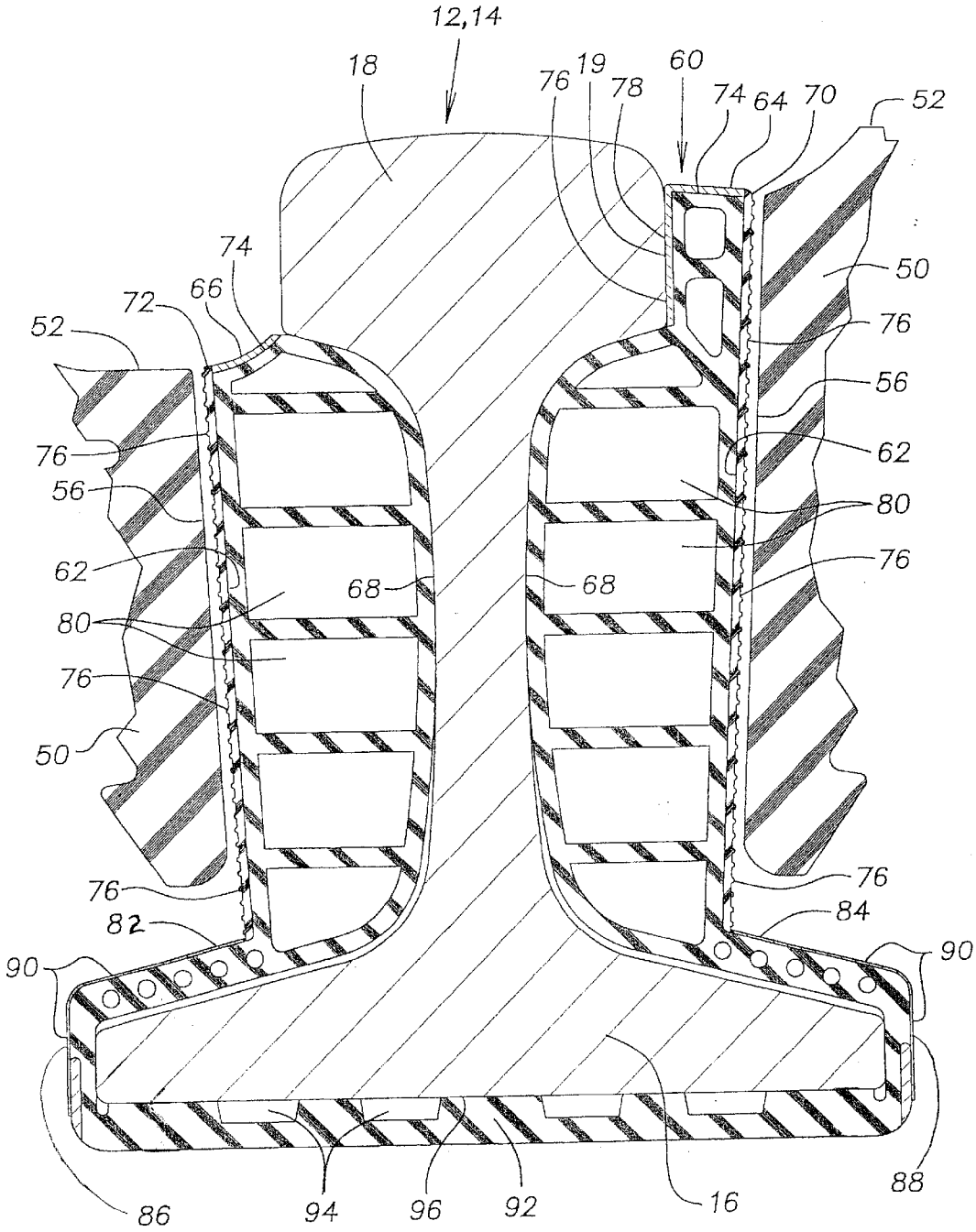
FIG. 4 is an enlarged, cross-sectional view of an elastomeric boot and a rail of an embodiment of the invention.

Referring now to FIG. 4, the elastomeric rail boot 60 is formed as a continuous piece that encases the rails 12, 14. The elastomeric rail boot 60 comprises a rail boot body having two exposed top surfaces 64, 66, an inner surface 68 and outer surface 62. The boot 60 extends from the base portion 16 of the rail to cover substantially all of an outer surface of the head portion 18.

The boot 60 extends uniformly along the rails 12, 14, having the same cross-sectional appearance throughout. The boot 60 is manufactured from various elastomers being good electrical insulators. The boot 60 can easily be provided in any lengths required to minimize joints and extend as far as possible within the embedded track structure 10, which varies among crossings.

The rail boot's 60 two exposed top surfaces 64, 66 are sloped away from the rails 12, 14 and have a minimum clearance on each side of the head 18 of the rails of 1" (25 mm). Top surfaces are designed to be a minimum of 1" wide to provide necessary relief from the adjacent surfaces and reduce the incidence of stray current leakage. An outside edge 70, 72 of each top surface 64, 66 is positioned flush with the top surface 52 of the filler bodies 50. This cooperation between the top surfaces 64, 66 and the top surface 52 facilitates flow of water and debris away from the rails 12, 14 and prevents the build-up of ice and other material on a top surface of the head 18.

Further, the top surfaces 64, 66 of the boot are formed with an elastomer material 74 that is more rigid and tougher that the elastomer of which the bulk of the boot 60 is primarily constructed. The elastomer material 74 helps to prevent the deformation and puncture of the top surfaces 64, 66 that may otherwise be caused by road traffic. Such deformation or puncturing may prevent the rail boot 60 from effectively facilitating the run off of water and debris, and additionally it may compromise the overall integrity of the boot 60.

The elastomer material 74 is coextruded with the boot 60 so that the latter is of "multi-durometer". Coextrusion is the process of extruding two or more materials through a single die with two or more orifices arranged so that the extrudates merge and weld together into a laminar structure before chilling. Each material is fed to the die from a separate extruder, but the orifices may be arranged so that each extruder supplies two or more plies of the same material. Coextrusion can be employed in film blowing, free film extrusion, and extrusion coating processes. The advantage of coextrusion is that each ply of the laminate imparts a desired characteristic property, such as stiffness, heat-sealability, impermeability or resistance to some environment, all of which properties would be impossible to attain with any single material.

The outside surface 62 provides an interface with the filler bodies 50. The outside surface 62 is provided with protrusions 76 to provide additional surface contact area with the outside surface or side 56 of filler bodies 50 to promote bonding.

Also adjacent to the top surface 64 is an inside surface 78 of the rail boot 60 which interfaces with an outside surface 19 on the gauge side of the rail. This inside surface 78 also comprises an extension of the elastomer material 74. The inside surface 78 is provided with protrusions 76 that promote the formation of a seal between the rail head 18 and the rail boot 60.

The rail boot 60 is provided with a plurality of longitudinal cavities 80 between an interior surface 68 and an exterior surface 62 of the rail boot 60. The plurality of longitudinal cavities 80 extend from the underside head of the rail 18 to the top of the base 16 of the rail 12, 14. The cavities allow the exterior surface 62 to maintain good contact with the filler bodies 50 and the interior surface 68 to stay in contact with the rail 12, 14, even if the rail 12, 14 and the filler bodies 50 shift slightly with respect to each other. Such shifting may occur as a result of settling, passing road traffic and periodic loading of the rails by trains. The mechanical separation significantly limits or eliminates cracking produced by movement of the rail and isolates the rail 12, 14 mechanically and provides two layers of protection from puncture or other incidental damage.

Top surfaces 82, 84 and outside surfaces 86, 88 of the rail boot 60 at the portion of the boot 60 that surrounds the rail flange 16 are provided with a bi-layered, multi-durometer material 90 similar to the elastomer material 74 of the top surfaces 64, 66. These surfaces 82, 84 are layered with a bi-layered, multi-durometer material 90. The extruded multi-durometer material 90 prevents the retaining clips 30 from puncturing or otherwise damaging the rail boot 60. If nylon-reinforced plastic retaining clips (not shown) are used with rail boot 60, the top surfaces 82, 84 are coextruded with a two- or three-layered, multi-durometer material 90. The material 90 may not be required if the clips 30 are formed from an elastomeric material, as shown for example in FIG. 3.

A bottom portion 92 of the rail boot 60 is provided with channels 94 that are adjacent to a bottom surface 96 of the rail flange 16. These channels 94 provide vertical movement for the rail boot 60 and, additionally reduce noise vibration transfer between the rail 12, 14 and the supporting beam 22 or supporting railroad ties (not shown). The shapes of the channels 94 allow the rail 12, 14 to flex vertically without transferring all of the low frequencies that are created while the rail cars are traveling on the rail.

The installation of the railway structure 10 will now be described in detail. First, the rail boot 60 portion of the structure is installed. The rail 12, 14 and boot 60 assembly is supported on either sacrificial or temporary support fixtures. The sacrificial support fixtures remain in the concrete with the installation. The temporary support fixtures are removed after the first lift of concrete. Support beams 22 may also be used. After a first pour of concrete, parallel to the base of the rail boot 60, the fasteners 34 that hold the rail in place are torqued to the appropriate design guidelines, these guidelines typically call for between 125 and 275 ft/lbs of torque. Once torqued, the gauge side filler pieces 53 (inside the two rails), and then the field side filler pieces 51 (outside the two rails) are installed. The filler pieces are installed by forcing the profile down over the top of the rail clips 30. Once the filler pieces are in place, concrete or paver blocks would be used to fill the street to the level top of the rail.

Although the invention has been shown and described with respect to certain embodiments, it is obvious that equivalent alterations and modifications will occur to others skilled in the art upon reading and understanding of the specification. The present invention includes all such equivalent alterations and modifications, and is limited only by the scope of the claims.

What is claimed is:

1. An insulation system for an embedded track construction for a transit railway including spaced parallel railway rails extending for indefinite lengths in a longitudinal direction and supported on a plurality of spaced ties disposed generally perpendicular to the rails, said system comprising:

a rail boot for substantially enclosing each of said rails along its length in said longitudinal direction;

rail clips extending in said longitudinal direction on each side of each of said rails across a plurality of said spaced ties for securing said rails to said ties; and fillers formed of elastomeric material extending in said longitudinal direction on each side of each of said rails engaging an outer side of said rail boot and a roadway lateral support surface, and removably mechanically interlocking with an associated one of said rail clips.

2. The system of claim 1, wherein said fillers cooperate to provide a coplanar roadway with said rails.

3. The system of claim 1, wherein said rail clips extend substantially continuously in said longitudinal direction and said filler is removably mechanically interlocked with said associated rail clip along substantially the entire extent thereof.

4. The system of claim 3, wherein each of said rail clips includes an elongate metal support substantially enclosed within an elastomeric member adjacent each of said spaced ties, and said elastomeric member extends substantially continuously in said longitudinal direction across said plurality of said spaced ties.

5. The system of claim 4, wherein said rail includes a lower flange and a head connected by a web, said rail clip and metal support include a generally horizontal portion arranged to extend over said flange and to secure said flange to said tie.

6. The system of claim 5, wherein said rail clip and metal support include openings for receiving fasteners for connecting said rail clip and metal support to said spaced ties and thereby securing said rails to said ties.

7. The system of claim 6, wherein said rail clip openings are closed by removably mechanically interlocking said fillers to said rail clips.

8. The system of claim 4, wherein said filler and associated rail clip include frictionally engaged and mechanically interlocked dove tail portions.

9. The system of claim 8, wherein said rail clip provides a male dove tail portion extending upwardly into a female dove tail portion provided by said filler.

10. The system of claim 9, wherein said male portion includes a transversely extending shoulder arranged to interlock with a similarly shaped region of said female portion.

11. The system of claim 10, wherein said fillers and said rail boots include a plurality of cavities extending in said longitudinal direction.

12. The system of claim 11, wherein said fillers and rail boots include associated side surfaces for providing lateral support.

13. The system of claim 11, wherein said rail boot comprises a coextruded body formed of at least first and second coextruded elastomeric materials, said first elastomeric material forming the bulk of said body and said second elastomeric material forming said associated surface as a protective layer, said elastomeric materials having different durometer hardnesses, said second elastomeric material being tougher and harder than said first elastomeric material.

14. The system of claim 1, wherein said rail includes a lower flange and a head connected by a web, said rail boot is shaped to enclose substantially all of said rail except said head and includes boot top surfaces arranged to extend from said head to said fillers.

15. The system of claim 14, wherein said fillers and rail boots include associated side surfaces for providing lateral support, said rail boot has a generally U-shape unitary cross-section for partially encasing said rail remote of said head and comprises a coextruded body formed of at least first and second coextruded elastomeric materials, said first elastomeric material forming the bulk of said body and said second elastomeric material forming said boot top surfaces and associated surfaces as protective layers, said elastomeric materials having different durometer hardnesses, said second elastomeric material being tougher and harder than said first elastomeric material.

16. The system of claim 1, wherein said rail includes a lower flange connected by a web to a head having exposed rail top surfaces, said fillers and rail boots include associated side surfaces for providing lateral support, said rail boot comprises a coextruded body formed of at least first and second coextruded elastomeric materials, said first elastomeric material forming the bulk of said body and said second elastomeric material forming protective layers at specific locations on said body, said first and second elastomeric materials being simultaneously coextruded and thermally bonded together at said specific locations as a coextrudate during coextrusion of said body, said elastomeric materials having different durometer hardnesses, said second elastomeric material being tougher and harder than said first elastomeric material, said boot having a generally U-shape unitary cross-section for partially encasing said rail remote of said rail top surfaces said body including exposed boot top surfaces arranged to extend to said fillers, said protective layers being located along said top and associated side surfaces of said body.

17. A grade crossing system for an insulated embedded track construction for a transit railway including first and second spaced, generally parallel railway rails having exposed top surfaces generally in the plane of a crossing roadway and extending for indefinite lengths in a longitudinal direction across said grade crossing, said rails being supported on a plurality of spaced ties disposed generally perpendicular to the rails in supporting relation thereto, said system comprising:

a rail boot for substantially enclosing each of said rails remote of said top surfaces along its length in said longitudinal direction;

a pair of continuous rail clips extending in said longitudinal direction on each side of each of said rails across a plurality of said spaced ties for securing said rails to said ties; and fillers formed of elastomeric material extending in said longitudinal direction on each side of each of said rails engaging an outer side of said rail boot and a roadway lateral support surface, and removably mechanically interlocking with an associated one of said rail clips, said fillers having top filler surfaces that are generally coplanar with the plane of the grade crossing.

18. The system of claim 17, wherein each of said rail clip includes an elongate metal support substantially enclosed within an elastomeric member adjacent each of said spaced ties, and said elastomeric member extends substantially continuously in said longitudinal direction across said plurality of said spaced ties.

19. The system of claim 18, wherein said rail includes a lower flange and a head connected by a web, said metal support includes a generally horizontally portion extending over said flange and secured to said tie remote of the flange.

20. The system of claim 18, wherein said filler and associated rail clip include frictionally engaged and mechanically interlocked male and female portions extending substantially continuously in said longitudinal direction.

21. The system of claim 20, wherein said rail clip provides said male portion extending upwardly into said female portion provided by said filler.

22. The system of claim 17, wherein said rail includes a lower flange connected by a web to a head providing said rail top surfaces, said rail boot has a generally U-shape unitary cross-section for partially encasing said rail remote of said head top surfaces and comprises a coextruded body formed of at least first and second coextruded elastomeric materials, said first elastomeric material forming the bulk of said body and said second elastomeric material forming said top surfaces as protective layers, said elastomeric materials having different durometer hardnesses, said second elastomeric material being tougher and harder than said first elastomeric material.

* * * * *